US008313213B2

(12) United States Patent
Lin et al.

(10) Patent No.: US 8,313,213 B2
(45) Date of Patent: Nov. 20, 2012

(54) ASSEMBLY STRUCTURE FOR LED LAMP

(75) Inventors: Kuo-Len Lin, Wugu Township, Taipei County (TW); Chen-Hsiang Lin, Wugu Township, Taipei County (TW); Mong-Hua Hung, Wugu Township, Taipei County (TW); Hwai-Ming Wang, Wugu Township, Taipei County (TW); Ken Hsu, Wugu Township, Taipei County (TW); Chih-Hung Cheng, Wugu Township, Taipei County (TW)

(73) Assignees: Cpumate Inc., New Taipei (TW); Golden Sun News Techniques Co., Ltd., New Taipei (TW)

( * ) Notice: Subject to any disclaimer, the term of this patent is extended or adjusted under 35 U.S.C. 154(b) by 654 days.

(21) Appl. No.: 12/539,643

(22) Filed: Aug. 12, 2009

(65) Prior Publication Data

US 2011/0038147 A1 Feb. 17, 2011

(51) Int. Cl.
*F21S 4/00* (2006.01)

(52) U.S. Cl. ... 362/225; 362/218; 362/223; 362/217.12; 362/217.15; 362/217.16

(58) Field of Classification Search ..... 362/225, 362/218, 223, 217.12, 217.15, 217.16, 235, 362/249.02, 368
See application file for complete search history.

(56) References Cited

U.S. PATENT DOCUMENTS

| | | | | |
|---|---|---|---|---|
| 6,220,721 | B1 * | 4/2001 | Chan et al. | 362/219 |
| 2006/0187660 | A1 * | 8/2006 | Liu | 362/294 |
| 2007/0070651 | A1 * | 3/2007 | Azuma et al. | 362/655 |

* cited by examiner

*Primary Examiner* — Sharon Payne
(74) *Attorney, Agent, or Firm* — Chun-Ming Shih; HDLS IPR Services

(57) ABSTRACT

An assembly structure for a LED lamp includes a cover plate, a LED module, fasteners and a mask. An inner surface of the cover plate is provided with a fixing portion. Both sides of the cover plate are formed with a slot respectively. The LED module has a substrate and a plurality of LED mounted on the substrate. The substrate is provided with an insertion hole. One end of the fastener is detachably connected into the insertion hole of the substrate and the other end thereof is fixed to the fixing portion. The mask is made of transparent materials and has an accommodating space for allowing the LED module to be disposed therein. Both sides of the mask defining the accommodating space are formed with a locking flange for inserting into the slot of the cover plate. With the above arrangement, the operator can assemble or detach the LED lamp quickly.

22 Claims, 7 Drawing Sheets

ASSEMBLY STRUCTURE FOR LED LAMP

BACKGROUND OF THE INVENTION

1. Field of the Invention

The present invention relates to a LED lamp, and in particular to an assembly structure for a LED lamp.

2. Description of Prior Art

Since light-emitting diodes (referred to as "LED" hereinafter) have advantages of low power consumption, long life, small volume and fast response time, they gradually replace traditional bulbs and are widely used in various lamps or light-emitting devices. In order to increase the illuminating range and brightness of such a lamp or light-emitting device, a plurality of LED is soldered with a circuit board to form a LED module. Then, the LED module is combined with a transparent mask and a metallic heat-dissipating cover. However, the transparent mask and the metallic heat-dissipating cover are made of different material, so that they usually need to be assembled together by screw elements.

The conventional LED lamp includes a LED circuit board, a transparent mask, a metallic heat-dissipating cover and two terminal units. By means of screw elements, the above-mentioned components can be assembled together to form a LED lamp.

However, in practical, the conventional LED lamp still has some problems. In order to tighten or loosen the screw elements, an operator needs to use a screw driver or other tool in assembling or detaching the LED lamp. It can be imaged that the operator uses his one hand to hold a component to be assembled (or detached) in the LED lamp while tightens (or loosens) the screws by the other hand. Thus, the operation is very inconvenient. Even, the operator may lose the screws.

On the other hand, since the transparent mask is a thin component made by plastic materials, the screw holes provided in the plastic-made transparent mask may be damaged due to the excessive force exerted by the operator when he assembles the LED lamp by screw elements. In this situation, it would become more difficult to assemble the whole set of the LED lamp. Even, the whole set of the LED lamp has to be replaced by a new set just because of a damaged transparent mask.

Therefore, it is an important issue for the present Inventor to solve the above-mentioned problems.

SUMMARY OF THE INVENTION

The present invention is to provide an assembly structure for a LED lamp, whereby the operator can assemble or detach the LED lamp directly without any tool.

The present invention is to provide an assembly structure for a LED lamp, which includes a cover plate having a fixing portion on its inner surface; a LED module having a substrate and a plurality of LED mounted on the substrate, the substrate being provided with an insertion hole; and at least one fastener with its one end detachably connected into the insertion hole of the substrate and the other end fixed to the fixing portion.

The present invention provides an assembly structure for a LED lamp, which includes a cover plate having a fixing portion on its inner surface, both sides of the cover plate being formed with a slot respectively; a LED module having a substrate and a plurality of LED mounted on the substrate, the substrate being provided with an insertion hole; at least one fastener with its one end detachably connected into the insertion hole of the substrate and the other end fixed to the fixing portion; and a mask made of transparent materials and having an accommodating space for allowing the LED module to be disposed therein, both sides of the mask defining the accommodating space being formed with a locking flange respectively for inserting into the slot of the cover plate.

In comparison with prior art, the present invention has advantageous features as follows.

(I) Since the cover plate and the LED module can be connected with each other by means of the fasteners, the operator can assemble or detach the LED lamp without using any tools. Thus, the operation is very simple and easy.

(II) Since the locking flanges of the mask can be inserted into the slots of the cover plate, both the mask and the cover plate are not provided with any screw holes. Thus, not only the assembly is fast and easy, but also the problem existed in prior art that the plastic-made mask may be damaged during the tightening of screws can be prevented.

DETAILED DESCRIPTION OF THE INVENTION

The characteristics and technical contents of the present invention will be described with reference to the accompanying drawings. However, the drawings are illustrative only but not used to limit the present invention.

Figure 1:
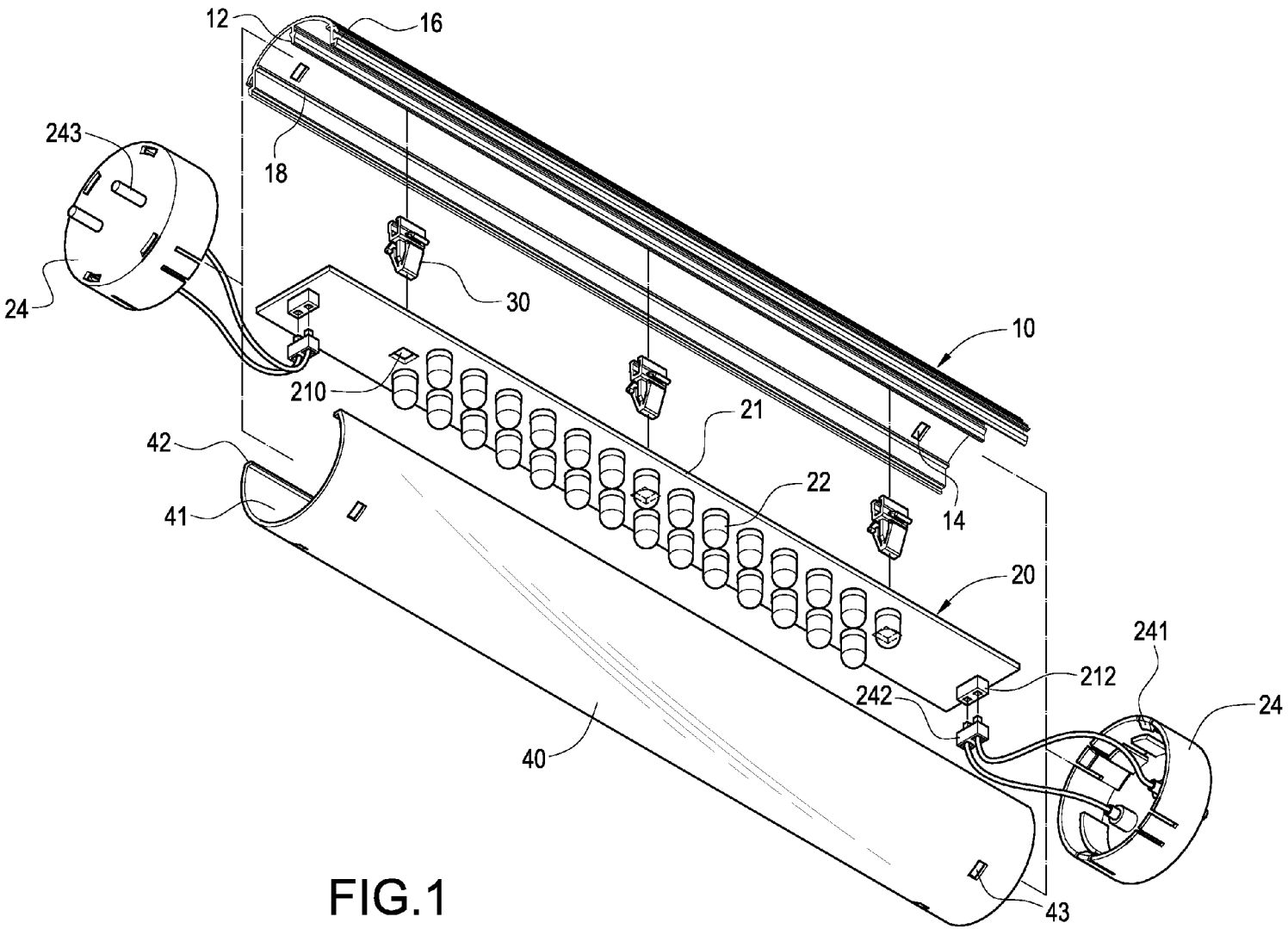
FIG. 1 is an exploded perspective view of the present invention.

Please refer to FIG. 1, which is an exploded perspective view of the present invention. The present invention provides an assembly structure for a LED lamp, which includes a cover plate 10, a LED module 20, at least one fastener 30 and a mask 40.

The cover plate 10 is made of metals having high heat conductivity (such as aluminum) for protecting the LED module 20 and dissipating the heat thereof. The inner surface of the cover plate 10 extends to form a fixing portion 12 for allowing the fastener 30 to be fixed thereto. Both ends of the cover plate 10 are provided with a plurality of holes 14. Both sides of the cover plate 10 are formed with a slot 16 respectively.

The LED module 20 comprises a substrate 21 and a plurality of LED 22 mounted on the substrate 21. The substrate 21 is provided with at least one insertion hole 210 for allowing the fastener 30 to be inserted therein. The LED module 20 further comprises a pair of caps 24. The cap 24 is electrically connected to the substrate 21 by inserting a terminal plug 242 of the cap 24 into a terminal socket 212 of the substrate 21. Two terminals 243 extending outwards from the cap 24 can be electrically connected to an external power source (not shown). With the above arrangement, the LED module 20 can be powered to operate normally.

Figure 2:
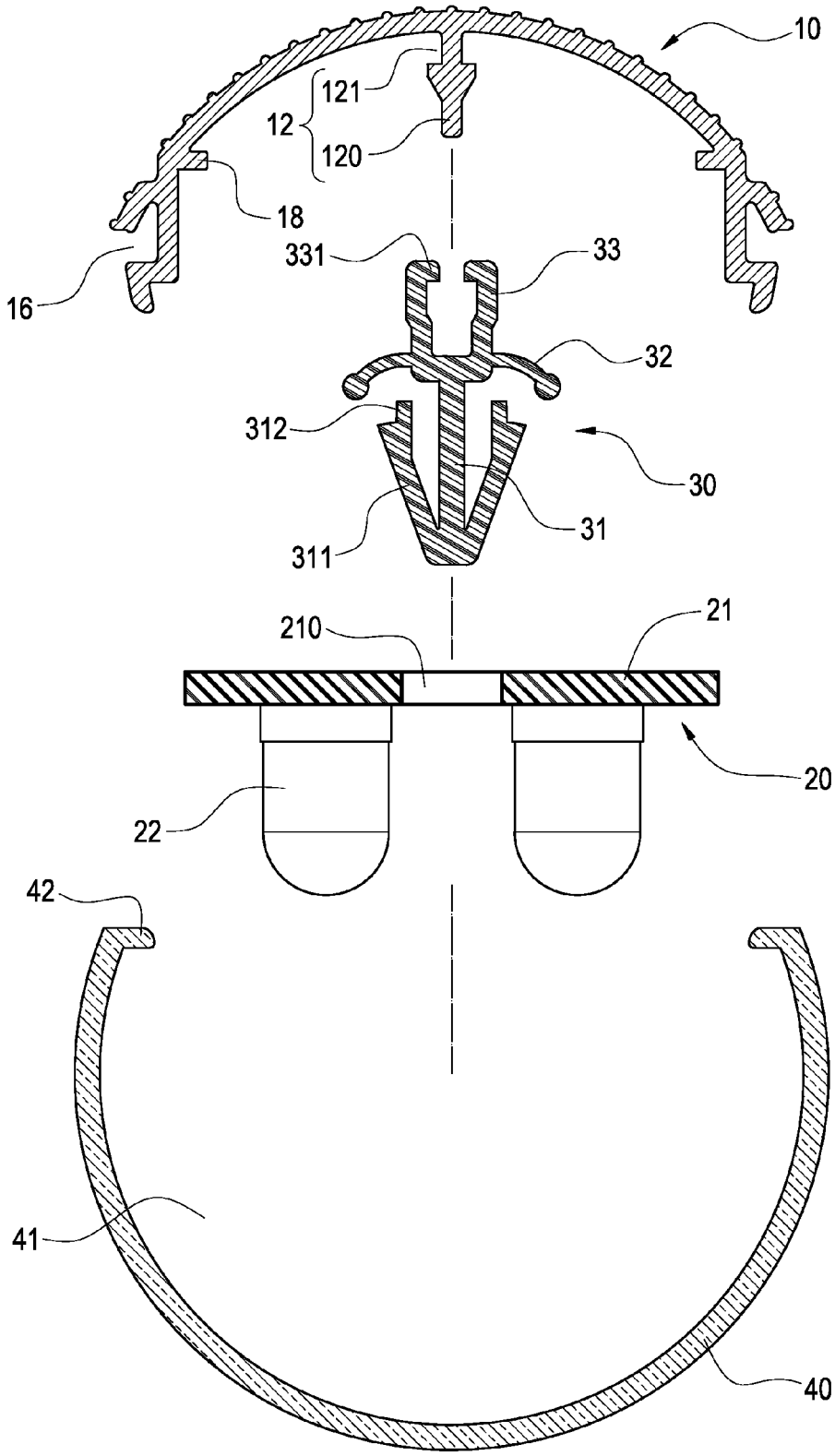
FIG. 2 is an exploded cross-sectional view of the present invention.

Please refer to FIG. 2. The fastener 30 includes an inserting section 31, a connecting section 33 and a stopping section 32 between the inserting section 31 and the connecting section 33. The inserting section 31 of the fastener 30 can be inserted into the insertion hole 210 of the substrate 21 with the stopping section 32 pressing on the substrate 21, so that the substrate 21 can be fixedly connected between the inserting section 31 and the stopping section 32 of the fastener 30. Further, the inserting section 31 is formed with a pair of elastic arms 311. The free end of each of the elastic arms 311 has a locking block 312 for locking in the insertion hole 210.

On the other hand, the connecting section 33 of the fastener 30 can be fixedly connected to the fixing portion 12 of the cover plate 10. In the embodiment of FIG. 2, the fixing portion 12 is a protruding strip 120 extending from the cover plate 10. The protruding strip 120 is provided with a pair of grooves 121. The connecting section 33 is formed with a pair of hooks 331 to be slidably connected into the grooves 121. With the inserting section 31 being inserted into the insertion hole 210 of the substrate 20 and the connecting section 33 being inserted into the grooves 121 of the protruding strip 120, the cover plate 10, the substrate 21 and the fastener 30 can be connected together tightly. Further, the inner surface of the cover plate 10 near its both sides are provided with a stopping strip 18 respectively, whereby the substrate 21 can be connected to the cover plate 10 firmly.

The mask 40 is made of transparent materials for transmitting the light emitted by the LED 22. The mask 40 can be connected with the cover plate 10 for protecting the LED module 20. The mask 40 is usually a thin component made of plastic materials. Both sides of the mask 40 define an accommodating space 41 for allowing the LED module 20 to be disposed therein. Both sides of the mask 40 defining the accommodating space 41 are formed with a locking flange 42 respectively for inserting into the slot 16 of the cover plate 10. With the above arrangement, the cover plate 10 and the mask 40 can be connected with each other firmly.

Please refer to FIG. 1 again. The periphery of the cap 24 extends to form a plurality of hooks 241. Both ends of the mask 40 are provided with a plurality of holes 43. The hooks 241 of the cap 24 can be hooked into the holes 14 of the cover plate 10 and the holes 43 of the mask 40 respectively. In this way, the cap 24, the cover plate 10 and the mask 40 can be connected together firmly.

Next, the steps of assembling the present invention will be described.

First, the inserting section 31 of the fastener 30 is inserted into the insertion hole 210 of the substrate 21 with the pair of elastic arms 311 of the inserting section 31 passing through the insertion hole 210 until the locking blocks 312 being fixed into the insertion hole 210. Then, the substrate 21 with the fastener 30 inserted thereto is mounted toward the cover plate 10, so that the connecting section 33 of the fastener 30 can be connected with the fixing portion 12 of the cover plate 10. In this way, the cover plate 10, the fastener 30 and the LED module 20 can be connected together firmly.

Figure 3:
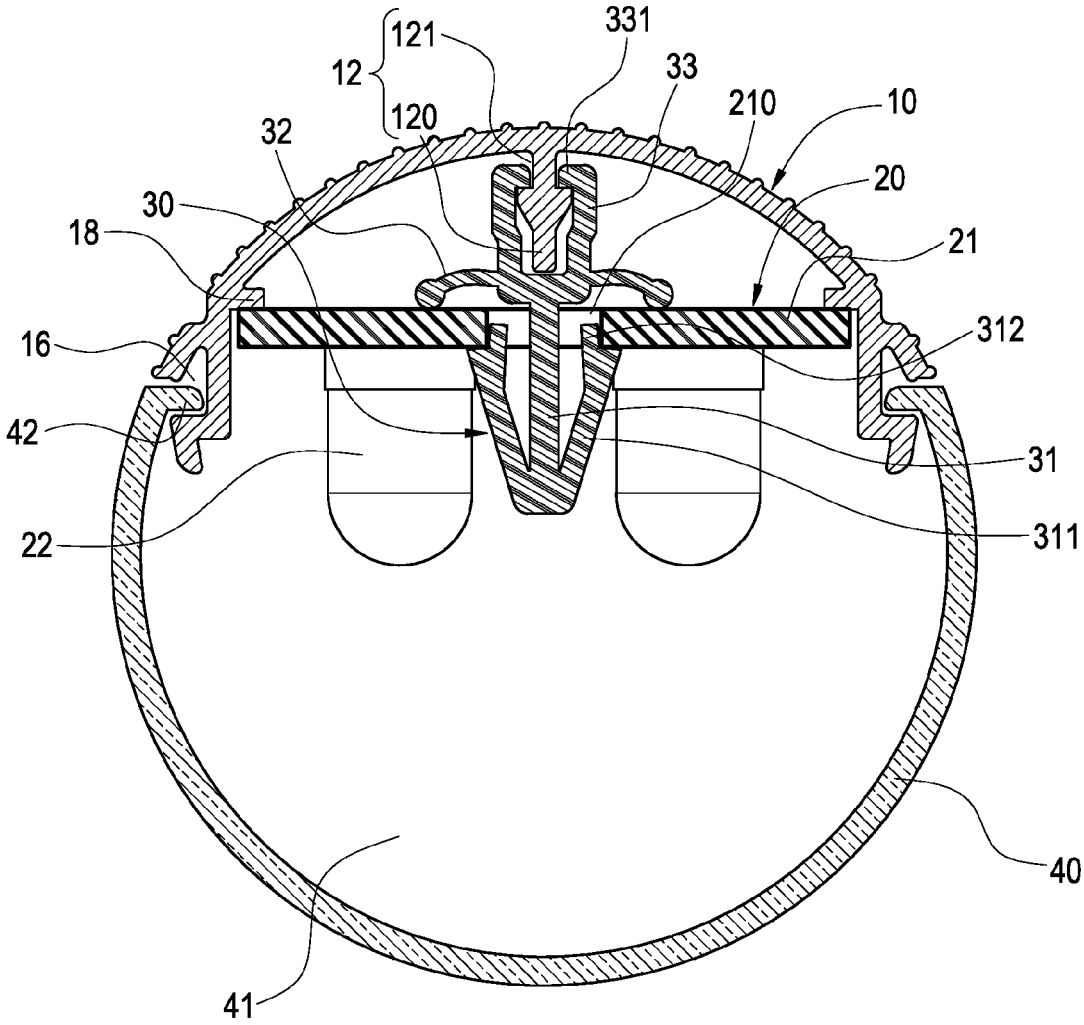
FIG. 3 is an assembled cross-sectional view of the present invention.
Figure 4:
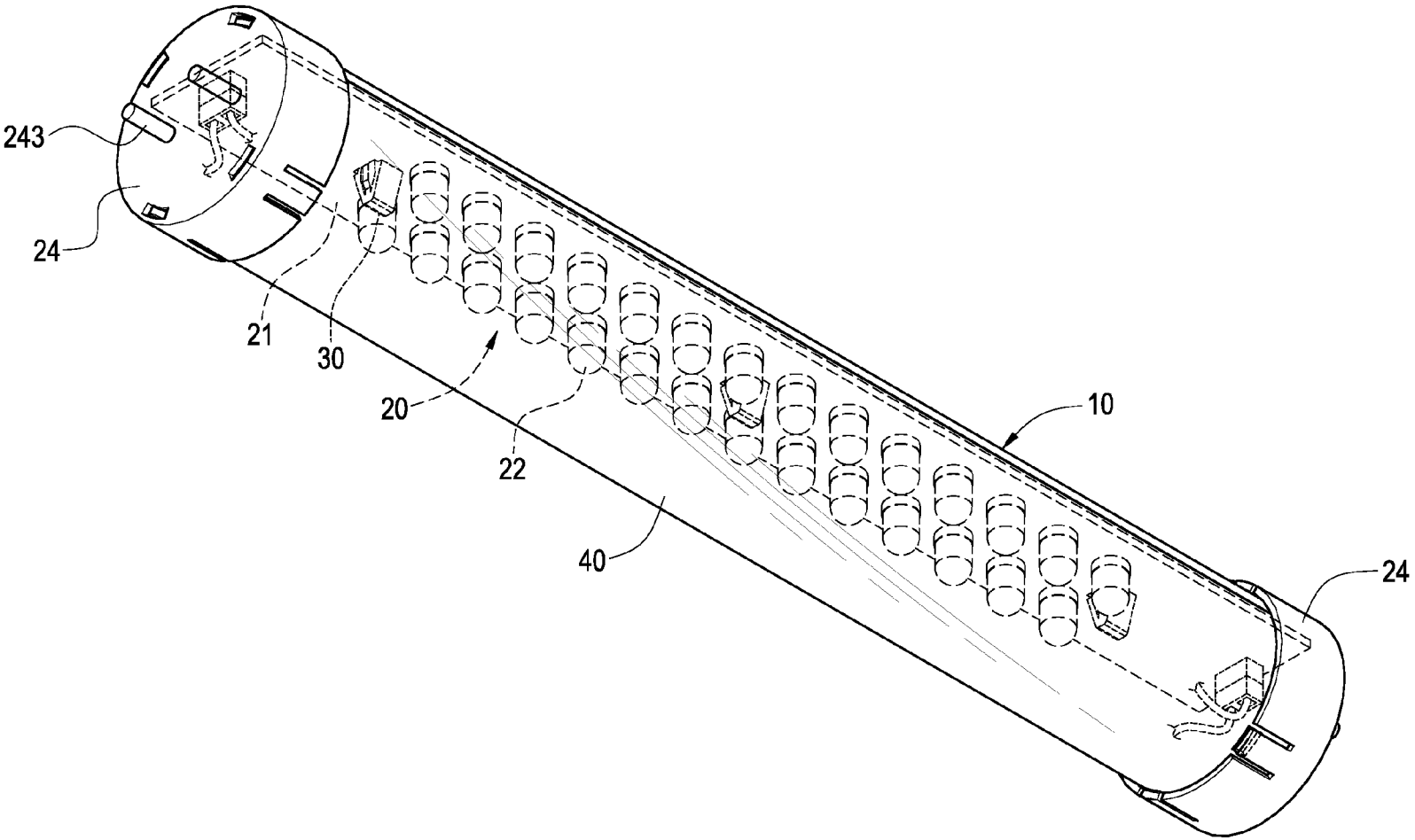
FIG. 4 is an assembled perspective view of the present invention.
Figure 5:
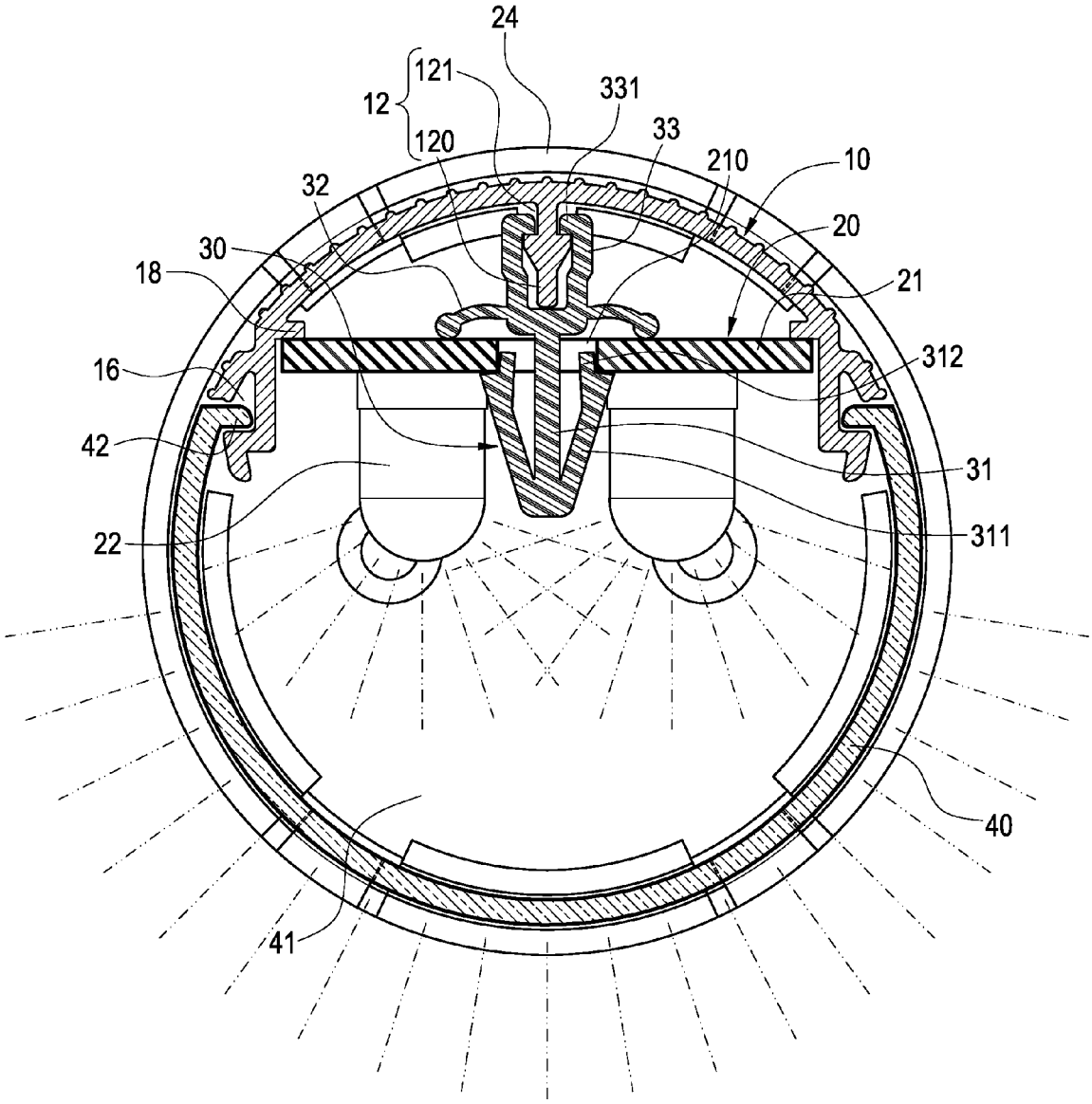
FIG. 5 is an assembled cross-sectional view showing the operating state of the present invention with two caps connected thereto.

Then, the locking flange 42 of the mask 40 is inserted into the slot 16 of the cover plate 10 with the LED module 20 being accommodated into the accommodating space 41 of the mask 40 (FIG. 3). Next, the terminal plug 242 of the cap 24 is inserted into the terminal socket 212 of the substrate 21. Finally, the two caps 24 cover the peripheries of the cover plate 10 and the mask 40 with the hooks 241 of the caps 24 being hooked into the holes 14 of the cover plate 10 and the holes 43 of the mask 40. In this way, the assembly of the present invention is completed. FIG. 4 shows the whole LED lamp after being assembled completely and FIG. 5 is a side cross-sectional view of FIG. 4.

As for the detaching process, its steps are performed in a sequence reverse to that of assembly. Thus, the redundant description is omitted. It should be noted that, when the user intends to mount a new substrate 21 because so many LED 22 on the old substrate are damaged to deteriorate the brightness of the LED lamp or the user intends to change the color of the LED 22, the user needs to detach the LED lamp. Thus, the user only needs to replace the damaged (or old) substrate 21 with a new one (mounted with LED 22). Therefore, when detaching the LED lamp, the user only needs to detach the caps 20 and the mask 40 and remove the terminal plug 241 from the terminal socket 212. Then, the user presses inwards the inserting section 31 of the fastener 30, so that the locking blocks 312 of the pair of elastic arms 311 can be removed from the insertion hole 210 of the substrate 21, thereby detaching the substrate 21 easily. Then, the user installs a new substrate 21 according to the assembling process. When detaching the LED lamp, it is not necessary to detach the fastener 30 from the fixing portion 12 of the cover plate 10, thereby extending the life of the fastener 30.

Figure 6:
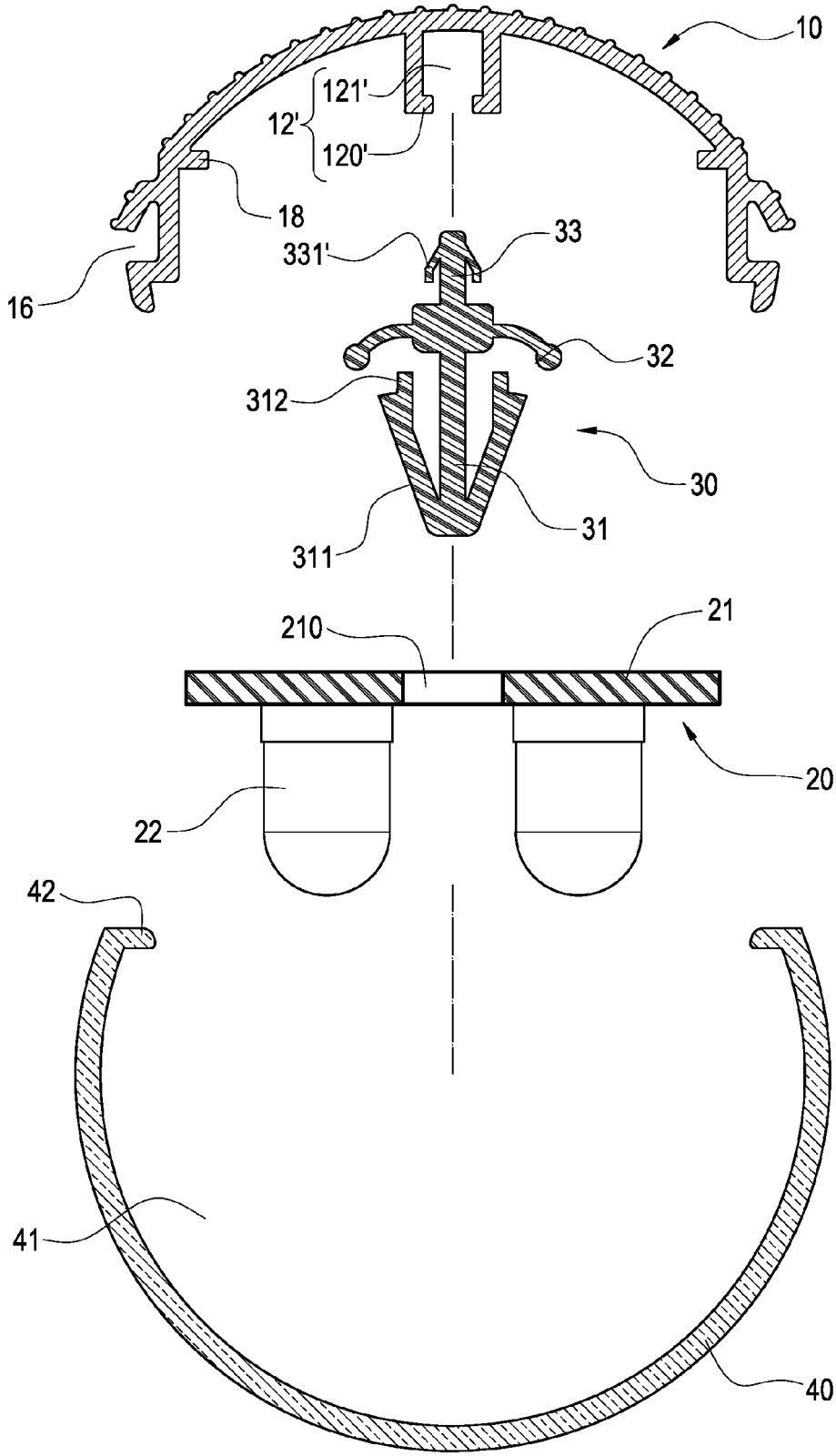
FIG. 6 is an exploded cross-sectional view showing another embodiment of the present invention.
Figure 7:
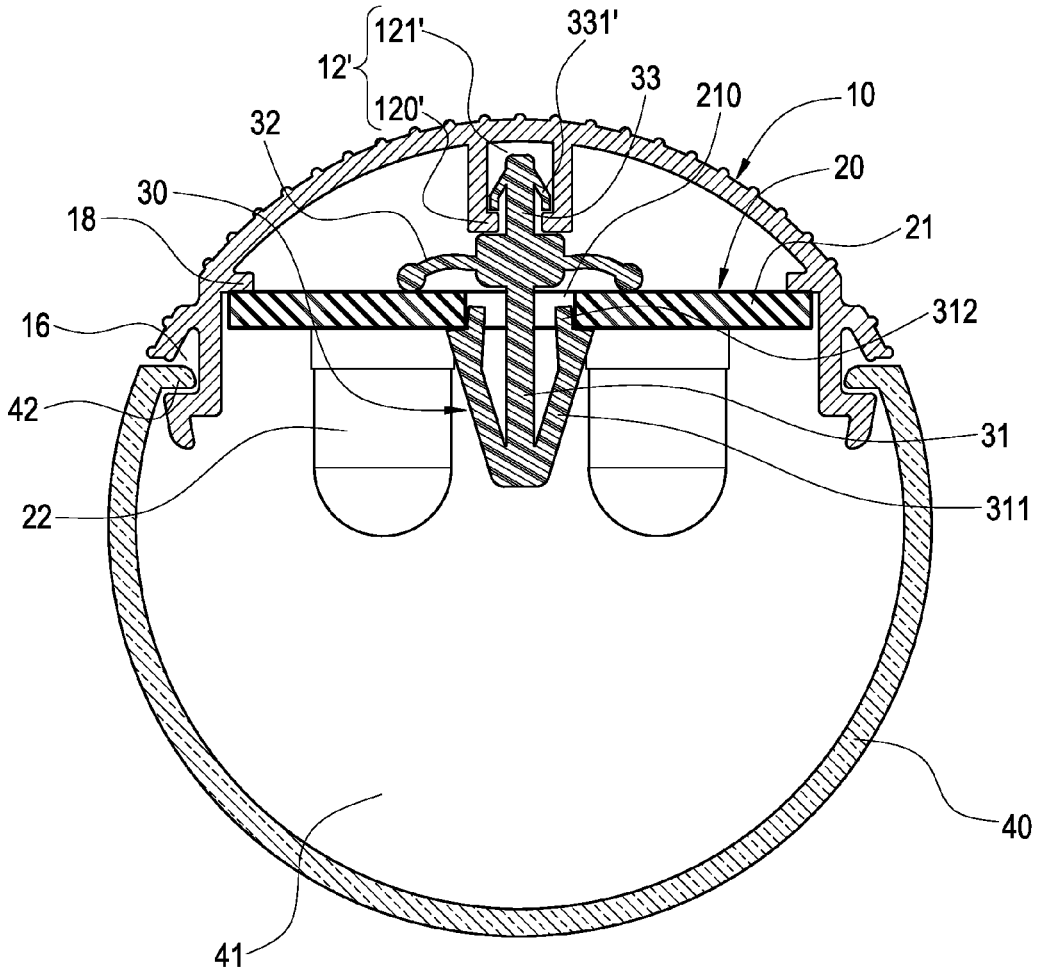
FIG. 7 is an assembled cross-sectional view showing another embodiment of the present invention.

Next, the fastener 30 according to another embodiment of the present invention will be described with reference to FIG. 6. As shown in FIG. 6, the difference between the present embodiment and the previous embodiment lies in that: the fixing portion 12' of the cover plate 10 forms two fastening pieces 120' extending from the cover plate 10. An insertion slot 121' is defined between the two fastening pieces 120'. The connecting section 33 of the fastener 30 is formed with a pair of elastic hooks 331' for inserting into the insertion slot 121'. With the pair of elastic hooks 331' of the connecting section 33 being inserted into the insertion slot 121' between the two fastening pieces 120', the fastener 30 can be fixedly connected to the cover plate 10, thereby achieving the same effect as that of the previous embodiment.

According to the above, the assembly structure for a LED lamp according to the present invention really demonstrates industrial applicability, novelty and inventive steps. Further, the structure of the present invention has not been seen in product of the same kind or let in public use. Thus, the present invention conforms to the requirements for a utility model patent.

What is claimed is:

1. An assembly structure for a LED lamp, comprising:

an arced and elongated cover plate having a fixing portion protruded from its inner surface and an elongated stopping strip extending inwardly from each of two longitudinal sides thereof;

a LED module having a substrate and a plurality of LED mounted on the substrate at a side opposite to the fixing portion, the substrate being provided with at least one insertion hole, wherein a surface of the substrate facing to the inner surface of the cover abuts to two stopping strips of the cover plate at two longitudinal edges thereof; and at least one fastener with its one end detachably connected into the insertion hole of the substrate and the other end slidably engaged to the fixing portion.

2. The assembly structure for a LED lamp according to claim 1, wherein the fastener comprises an inserting section and a stopping section connected to the inserting section, the inserting section is inserted into the insertion hole of the substrate with the stopping section pressing on the surface of the substrate.

3. The assembly structure for a LED lamp according to claim 2, wherein the inserting section is formed with a pair of elastic arms, free ends of the pair of elastic arms have a locking block respectively, the locking blocks are fixed into the insertion hole.

4. The assembly structure for a LED lamp according to claim 2, wherein the fixing portion is a protruding strip extending from the cover plate, the fastener further comprises a connecting section connected to the stopping section, the connecting section is slidably connected to the protruding strip.

5. The assembly structure for a LED lamp according to claim 4, wherein the protruding strip is provided with a pair of grooves, the connecting section is formed with a pair of hooks for hooking into the pair of grooves.

6. The assembly structure for a LED lamp according to claim 2, wherein the fixing portion forms two fastening pieces extending from the cover plate, the fastener further comprises a connecting section connected to the stopping section, the connecting section is slidably connected to the two fastening pieces.

7. The assembly structure for a LED lamp according to claim 6, wherein a slot is defined between the two fastening pieces, the connecting section is formed with a pair of elastic hooks for hooking into the slot.

8. The assembly structure for a LED lamp according to claim 1, wherein the substrate is a circuit board.

9. The assembly structure for a LED lamp according to claim 8, wherein the LED module further comprises a pair of caps electrically connected to both ends of the substrate.

10. The assembly structure for a LED lamp according to claim 9, wherein both ends of the cover plate are provided with a plurality of holes, the pair of caps extends to have a plurality of hooks for hooking into the holes.

11. The assembly structure for a LED lamp according to claim 1, wherein the cover plate is made of aluminum.

12. An assembly structure for a LED lamp, comprising:

an arced and elongated cover plate having a fixing portion protruded from its inner surface, both longitudinal edges of the cover plate being formed with an elongated slot respectively;

a LED module having a substrate and a plurality of LED mounted on the substrate at a side opposite to the fixing portion, the substrate being provided with at least one insertion hole;

at least one fastener with its one end detachably connected into the insertion hole of the substrate and the other end slidably engaged to the fixing portion; and an arced and elongated mask made of transparent materials and engaged with the cover plate to form a lamp tube having an accommodating space inside for allowing the LED module to be disposed therein, both longitudinal edges of the mask being formed with an elongated locking flange respectively for inserting into the slot of the cover plate.

13. The assembly structure for a LED lamp according to claim 12, wherein the fastener comprises an inserting section and a stopping section connected to the inserting section, the inserting section is inserted into the insertion hole of the substrate with the stopping section pressing on the substrate.

14. The assembly structure for a LED lamp according to claim 13, wherein the inserting section is formed with a pair of elastic arms, free ends of the pair of elastic arms have a locking block respectively, the locking blocks are fixed into the insertion hole.

15. The assembly structure for a LED lamp according to claim 13, wherein the fixing portion is a protruding strip extending from the cover plate, the fastener further comprises a connecting section connected to the stopping section, the connecting section is slidably connected to the protruding strip.

16. The assembly structure for a LED lamp according to claim 15, wherein the protruding strip is provided with a pair of grooves, the connecting section is formed with a pair of hooks for hooking into the pair of grooves.

17. The assembly structure for a LED lamp according to claim 13, wherein the fixing portion forms two fastening pieces extending from the cover plate, the fastener further comprises a connecting section connected to the stopping section, the connecting section is slidably connected to the two fastening pieces.

18. The assembly structure for a LED lamp according to claim 17, wherein a slot is defined between the two fastening pieces, the connecting section is formed with a pair of elastic hooks for hooking into the slot.

19. The assembly structure for a LED lamp according to claim 12, wherein the substrate is a circuit board.

20. The assembly structure for a LED lamp according to claim 19, wherein the LED module further comprises a pair of caps engaged to two ends of the lamp tube and electrically connected to both ends of the substrate.

21. The assembly structure for a LED lamp according to claim 20, wherein both ends of the cover plate are provided with a plurality of holes, both ends of the mask are provided with a plurality of holes, the pair of caps extend to have a plurality of hooks for hooking into the holes of the cover plate and the mask.

22. The assembly structure for a LED lamp according to claim 12, wherein the cover plate is made of aluminum.

* * * * *

UNITED STATES PATENT AND TRADEMARK OFFICE

CERTIFICATE OF CORRECTION

PATENT NO. : 8,313,213 B2
APPLICATION NO. : 12/539643
DATED : November 20, 2012
INVENTOR(S) : Lin et al.

It is certified that error appears in the above-identified patent and that said Letters Patent is hereby corrected as shown below:

In Column 3, Line 19, delete "substrate 20" and insert -- substrate 21 --, therefor.

In Column 4, Line 11, delete "caps 20" and insert -- caps 24 --, therefor.

Signed and Sealed this
Twenty-sixth Day of February, 2013

Teresa Stanek Rea
*Acting Director of the United States Patent and Trademark Office*